United States Patent [19]

Rocquin

[11] 4,416,479

[45] Nov. 22, 1983

[54] ATTACHABLE CARRIER HANDLE AND PICK-UP APPARATUS

[76] Inventor: Camille J. Rocquin, 1410 Demosthenes St., Metairie, La. 70005

[21] Appl. No.: 411,915

[22] Filed: Aug. 26, 1982

[51] Int. Cl.[3] ..... A01K 29/00

[52] U.S. Cl. ..... 294/1 B; 294/33

[58] Field of Search ..... 294/1 B, 1 BA, 1 BB, 294/27 R, 27 H, 31 R, 33, 170, 171; 16/114 R; 206/223, 496

[56] References Cited

U.S. PATENT DOCUMENTS

| | | | |
|---|---|---|---|
| 1,575,232 | 3/1926 | Shearer | 294/27 R |
| 2,800,353 | 7/1957 | Denham et al. | 294/31 R |
| 2,944,713 | 7/1960 | Beach | 294/170 X |
| 4,186,955 | 2/1980 | Campbell | 294/1 B |

FOREIGN PATENT DOCUMENTS

| | | | |
|---|---|---|---|
| 2935502 | 3/1981 | Fed. Rep. of Germany | 294/1.3 |

*Primary Examiner*—Johnny D. Cherry
*Attorney, Agent, or Firm*—Bode & Smith

[57] ABSTRACT

An apparatus for engaging onto a shouldered container, the apparatus having a pair of triangulated portions wherein the base of each triangulated portion is an inwardly disposed lip for engagement beneath the shoulder of a shouldered carrier, and the top portions of each triangulated portion making contact with the container shoulder itself. There is further provided a downward disposed member which would engage the inside surface of the shoulder portion so that the shouldered portion is firmly held between each triangulated portion and each downward disposed member. Each triangulated portion would be integrally attached to a handle carrier which overall would define substantially a U-shaped handle, wherein the container could then be lifted through grasping of the U-shaped handle across the horizontally disposed portion of the U. There is further provided pick-up member having a double surfaced pad wherein at least one surface is a moisture proof plastic adhered to an inner surface of absorbent cloth or the like, wherein picking up a moisture laying object would permit adhesion to the object without the moisture seeping through the moisture barrier layer.

2 Claims, 6 Drawing Figures

ATTACHABLE CARRIER HANDLE AND PICK-UP APPARATUS

BACKGROUND OF THE INVENTION

1. Field of the Invention

The present invention relates to an attachable carrier pick-up apparatus. More particularly, the present invention relates to an apparatus for attaching to a shouldered container, including pick-up means for placing droppings or the like in the container.

2. General Background

In the field of containers which are carried about through the use of a handle or the like, for retrieving objects on the ground such as fallen fruit, debris, or dog droppings, it is the usual case where the handle or carrier means is non-detachable from the container, due to the fact that the handle is usually inserted through a hole in the container and may swivel from side to side when not in use, and cannot be easily removed from the container should the container become worn or a break occur in the container which makes it non-usable.

In such an event, the container is usually thrown away along with the handle, and although the handle may be in rather good shape for further use, since it is, for the most part, non-detachable from the container, the handle is discarded along with the container.

In the present state of the art, there is presently on the market various types of holders for containers, some of which are detachable or non-detachable. In view of the present invention, which will describe an invention for a detachable handle, the most pertinent art may be the type of handle which at the present time would snap onto the container through engagement with a rivet or the like type of protrusion, so that the handle, although it is a detachable handle, nevertheless must attach itself to that particular container in view of the fact that the container is adapted with this type of means for attaching.

In view of the fact that the container again, must be custom made in order to adapt to this particular type of handle means, the problem of the utilization of a typical container having a shouldered top portion, whereby a detachable handle could be inserted, has not been solved, and this particular invention attempts to do this as will be described further.

Also, there is a need for a pick-up means which would enable the user to be protected from contact with a soiled item to be picked up by same.

GENERAL DISCUSSION OF THE PRESENT INVENTION

The preferred embodiment of the apparatus of the present invention seeks to solve the problems as found in the art in a simple and straightforward manner. What is provided is an apparatus for engaging onto a shouldered container, the apparatus having a pair of triangulated portions wherein the base of each triangulated portion is an inwardly disposed lip for engagement beneath the shoulder of a shouldered carrier, and the top portions of each triangulated portion making contact with the container shoulder itself. There is further provided a downward disposed member which would engage the inside surface of the shoulder portion so that the shouldered portion is firmly held between each triangulated portion and each downward disposed member. Each triangulated portion would be integrally attached to a handle carrier which overall would define substantially a U-shaped handle, wherein the container could then be lifted through grasping of the U-shaped handle across the horizontally disposed portion of the U. There is further provided pick-up means having a double surfaced pad wherein at least one surface is a moisture proof plastic adhered to an inner surface of absorbent cloth or the like, wherein picking up a moisture laying object would permit adhesion to the object without the moisture seeping through the moisture barrier layer.

Therefore, it is an object of the present invention to provide an apparatus for easily detaching onto a shouldered or the like container for carrying the container;

it is a further object of the present invention to provide an apparatus for easy removal from a container which has been worn or no longer useful, and reattachable to a usable container;

it is a further object of the present invention to provide pick-up means for retrieving objects off the ground or the like without moisture from the object making contact with the users skin;

in order to accomplish the above objects of the invention, it is a feature of the invention to provide a carrier apparatus having a substantially a U-shaped handle means with a padded portion for gripping by the human hand;

it is a further feature of the apparatus to provide a pair of triangulated portions for engagement with the shoulder portion of the container enabling the container to be lifted by said apparatus;

it is a further feature of the present invention to provide a pick-up means for retrieving objects off the ground or the like wherein one layer of the means is an absorbent cloth and the second layer is a moisture proof layer for preventing contact with the human hand.

BRIEF DESCRIPTION OF THE DRAWINGS

For a further understanding, of the nature and objects of the present invention, reference should be had to the following detailed description, taken in conjunction with the accompanying drawings, in which like parts are given like reference numerals and, wherein.

DETAILED DESCRIPTION OF THE PREFERRED EMBODIMENT

Figure 1:
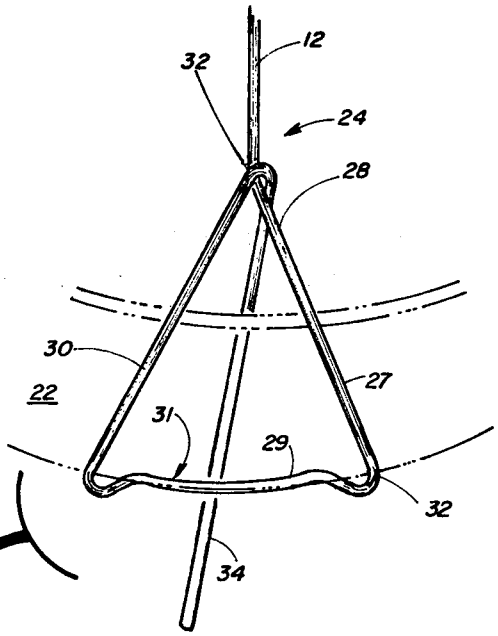
FIG. 1 is an exploded view of the triangulated portion of the preferred embodiment of the apparatus of the present invention.
Figure 2:
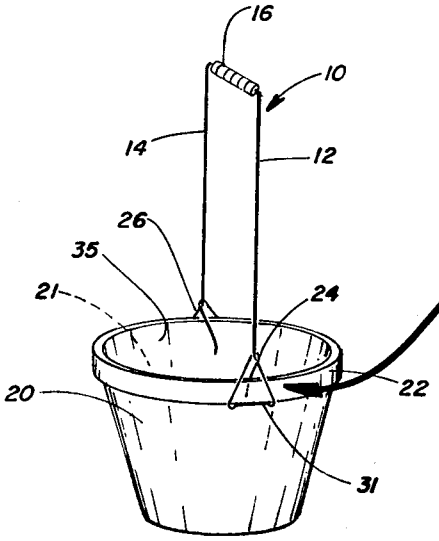
FIG. 2 is an overall perspective view of the preferred embodiment of the apparatus of the present invention illustrating its position on a shouldered container.
Figure 3:
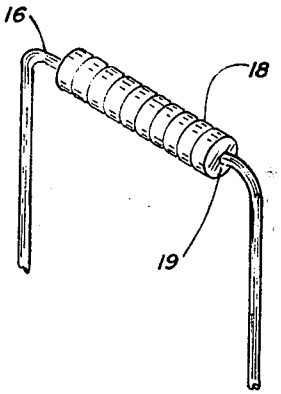
FIG. 3 is an exploded view of the handle portion of the apparatus of the present invention.

FIGS. 1 through 3 illustrate the carrier apparatus 10 of the preferred embodiment of the apparatus of the present invention. Carrier 10 comprises essentially a U-shaped handle carrier having vertically extending handle supports 12 and 14 integrally interconnected via handle means 16 at their uppermost ends. In FIG. 3, there is further illustrated in exploded view handle means 16 having cylindrical pad support 18, which is, in the preferred embodiment, sponge or the like for serving as a pad for the holder, with handle means 16 insertable through the center 19 of pad 18 for more comfort of the person carrying the apparatus.

As further illustrated in FIGS. 1 and 2, carrier 10 is a detachable carrier which may attach and detach easily onto a container 20, which would be a typical shouldered container, preferably of a light plastic or the like, for carrying fallen fruit, debris, or dog droppings or the like within its container area 21. Container 20, for proper utilization of carrier means 10, would be of the type which is adapted with upper shoulder portion 22 which is a typical shouldered portion integral with the top edge of container 20 and extending around the entire circumference of container 20 for serving as a means for easy manual pick-up of container 20 during its use. Utilizing this shoulder portion 22 for support, carrier apparatus 10 further comprises a pair of triangulated portions 24 and 26, each of said triangulated portions 24 and 26 being an integral extension of the bottom end of vertical handle portions 12 and 14 respectively. Because both triangulated portions 24 and 26 are identical in nature, only portion 24 will be described in detail, as seen in FIG. 1. However, you will please note that in FIG. 2, triangulated portions 24 and 26 are positioned approximately 180° from one another along the circumference of shoulder 22 so that container 20 may be picked up by handle means 10 in a balanced fashion, and not tend to sway one side or the other.

As illustrated in FIG. 1, an exploded view, triangulated portion 24 leads off of the end portion of vertical handle 12 defining a triangulated metal exterior support bracket 27 which comprises a first upper angulated member 28, a base member 29 integrally attached thereto and a second upper angulated member 30, said members substantially defining the equilateral triangular portion 24. FIG. 1 further illustrates base member 29 which defines an inwardly folded lip 31 which would, in the preferred embodiment, be positioned beneath the bottom edge 32 of shoulder 22, (illustrated in phanthom), so that any upward force on handle means 12 or 14 would lift container 20 by the support of shoulder 22 by lip portion 31. Of course, triangulated means 26 would function in the same manner as described above.

As further illustrated in FIGS. 2 and 3, in view of the fact that triangulated bracket 24 or 26 is simply an extension of handle 12 or 14 respectively, and is really integrally formed from simply bending the handle to form the triangulated bracket, upper extending member 30 would further proceed to "wrap" over the juncture of handle 12 and upper member 28 at point 32 and extend substantially vertically downward as inner vertically disposed member 34. In the preferred embodiment, member 34 would engage with the inner wall 35 of container 20, so that shoulder 22, while being supported by triangulated brackets 24 and 26, would also be pincered in place between triangulated brackets 24 and 26 and vertically disposed member 34 on its innerside. That being the case, lip 31 would be held in position along the underside of shoulder 22 during use. Of course, when one would want to release handle means 10 from container 20, one would only have to put slight pressure in moving triangulated brackets 24 and 26 outward so that lip 31 would no longer engage shoulder 22 and the handle would easily slip off the container 20. Likewise, in order to attach handle 20, again, the triangulated brackets 24 and 26 would simply be moved outward from vertically disposed arm 34 and slid onto shoulder 22 until lip 31 had engaged the underside 32 of shoulder 22 and is ready for use.

In the preferred embodiment, there may be included a plastic bag or the like which would be insertable into the shouldered container whereby any debris or items placed into the shouldered container could be retrieved along with the plastic bags so that the shouldered container would be reusable as the handle is attached and unattached therefrom.

Figure 6:
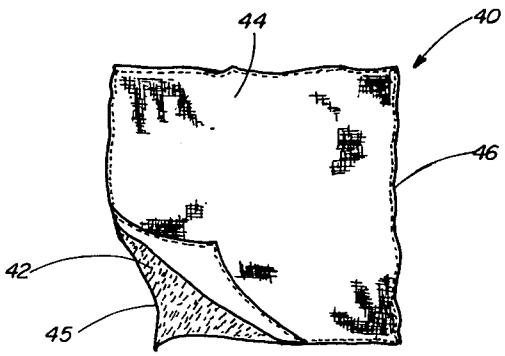
FIG. 6 is a top view of the pick-up means of the apparatus of the present invention illustrating in fold-away view, the adherence to one another of the surfaces illustrated in FIGS. 4 and 5.
Figure 5:
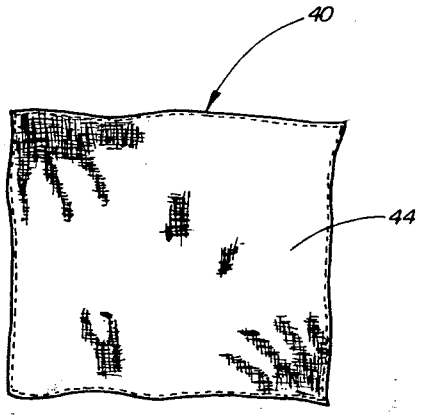
FIG. 5 is a top view of the cloth, absorbent surface of the pick-up means of the apparatus of the present invention.
Figure 4:
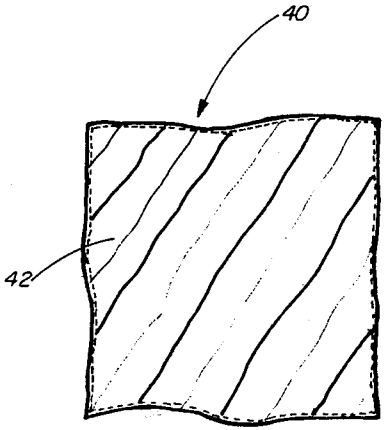
FIG. 4 is a top view of the pick-up means illustrating the upper moisture-proof surface of the apparatus of the present invention.

FIGS. 4 through 6 further illustrate pick-up means 40 in the preferred embodiment of the apparatus of the present invention. Pick-up means 40 would essentially be a substantially square section of material comprising an outer later 42 of flexible plastic or the like which is substantially moisture proof during use. In FIG. 5, there is illustrated the second side 44 of pick-up means 40, which comprises an absorbent, flexible cloth layer, which, during use, would make contact with the item being picked up by apparatus 40. In FIG. 6, there is illustrated corner 45 of pick-up means 40 which illustrates the double layered affect when plastic layer 42 and cloth layer 44 are adhered together in order to form pick-up means 40. In the preferred embodiment, the layers 42 and 44 would be adhered together via stitching 46 along their edge or some other adhesion means such as glue or the like. In order to properly use, one would hold means 40 in one's hand with the hand making contact with the moisture proof side 42, with the cloth side 44 away from one's hand, and the cloth side making contact with the item to be picked-up such as dog droppings or the like. Therefore, upon pick-up of the item, the absorption layer serves to pick-up most if not all of the item, and the moisture proof layer 42 serves to protect one's hand. In use with apparatus 10, this item can be utilized in assuring that the items being picked up to be deposited in container 20 are properly picked up in one's hands and remain substantially clean and free from contact with the items being picked up.

In the preferred embodiment, pick-up apparatus 40 may be adapted with scent on the cloth 44 side so that any unsavory odors which may be emitted from the debris pick-up, such as dog droppings, may be less noxious, and more esily utilized.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A disposable pick-up apparatus having removable handle means, comprising:

a. a container portion having a continuous side wall, and a bottom portion integrally attached to said side wall, together defining a container space therein; said side wall further comprising an upper annular shoulder portion therearound;

b. removable handle means, comprising:

i. a substantially horizontally disposed handle portion having cushion means therearound for grasping; and ii. first and second downwardly depending extender portions connectable on their upper ends to said horizontal handle portion, and on their lower ends, each of said extender portions further comprising inner and outer flexing members, having triangulated brackets wherein the base of said triangulated bracket engages the bottom edge of said shoulder portion of said container, and said inner flexing member engages the inner wall of said container for maintaining said shoulder portion at rigid engagement therebetween; wherein upon outward flexing, said flexing members disengage said shoulder portion of said container; and c. pick-up means, for retrieving items to be picked up, said means further comprising at least a first moisture-proof surface, and a second adhering textured surface for making contact with the item to be picked up.

2. The apparatus in claim 1, wherein said container portion is completely disposable and replaceable by a second container portion of like structure.

* * * * *